US010246289B2

(12) United States Patent
Sackfield

(10) Patent No.: US 10,246,289 B2
(45) Date of Patent: Apr. 2, 2019

(54) BANKNOTE STORAGE UNIT

(71) Applicant: Innovative Technology Limited, Oldham (GB)

(72) Inventor: Martin Sackfield, Oldham (GB)

(73) Assignee: Innovative Technology Limited, Oldham (GB)

( * ) Notice: Subject to any disclaimer, the term of this patent is extended or adjusted under 35 U.S.C. 154(b) by 33 days.

(21) Appl. No.: 15/794,154

(22) Filed: Oct. 26, 2017

(65) Prior Publication Data

US 2018/0148290 A1 May 31, 2018

(30) Foreign Application Priority Data

Nov. 30, 2016 (GB) ..... 1620313.5

(51) Int. Cl.

| | |
|---|---|
| ***B65H 29/00*** | (2006.01) |
| ***G07D 11/18*** | (2019.01) |
| ***G07D 11/50*** | (2019.01) |
| ***G07D 11/24*** | (2019.01) |

(52) U.S. Cl.

CPC ..... *B65H 29/006* (2013.01); *G07D 11/18* (2019.01); *G07D 11/24* (2019.01); *G07D 11/50* (2019.01); *B65H 2220/09* (2013.01); *B65H 2301/4191* (2013.01); *B65H 2301/41912* (2013.01); *B65H 2301/41924* (2013.01); *B65H 2403/54* (2013.01); *B65H 2403/722* (2013.01); *B65H 2403/725* (2013.01); *B65H 2403/73* (2013.01); *B65H 2701/1912* (2013.01); *G07D 2211/00* (2013.01)

(58) Field of Classification Search

CPC ..... B65H 29/006; B65H 2301/4191; B65H 2701/1912; G07D 11/0084; G07D 11/0033; G07D 11/50; G07D 11/18; G07D 11/24

See application file for complete search history.

(56) References Cited

U.S. PATENT DOCUMENTS

| | | | | |
|---|---|---|---|---|
| 6,371,473 | B1 * | 4/2002 | Saltsov | B65H 29/006 271/3.01 |
| 6,626,751 | B1 * | 9/2003 | Umeda | G07D 9/008 453/57 |
| 8,376,116 | B2 | 2/2013 | Robinson et al. | |
| 2005/0127163 | A1 * | 6/2005 | Minamishin | G07D 7/162 235/379 |
| 2015/0021385 | A1 * | 1/2015 | Michels | B65H 29/006 232/43.1 |

FOREIGN PATENT DOCUMENTS

| | | |
|---|---|---|
| EP | 1 321 409 | 6/2003 |
| WO | WO 2006/004523 | 1/2006 |
| WO | WO 2010/061160 | 6/2010 |

OTHER PUBLICATIONS

UK Search Report for App No. GB1620313.5—Date of Search May 26, 2017, ( 1 page).

* cited by examiner

*Primary Examiner* — Mark J Beauchaine

(74) *Attorney, Agent, or Firm* — Woodard, Emhardt, Henry, Reeves & Wagner, LLP

(57) ABSTRACT

A banknote storage unit comprising: a first tape reel banknote storage device; a second tape reel banknote storage device; and a drive transmission means pivotable between engagement with said first tape reel banknote storage device and engagement with said second tape reel banknote storage device.

10 Claims, 5 Drawing Sheets

BANKNOTE STORAGE UNIT

REFERENCE TO RELATED APPLICATIONS

This application claims priority of Great Britain Application No. 16 203 13.5, filed 30 Nov. 2016, the disclosure of which is incorporated herein by reference in its entirety.

The present invention relates to apparatus which can accept, dispense and store sheets or documents of value. In particular, the present invention relates to a banknote storage unit that can be used in conjunction with a banknote transport and validation device to form what is commonly known in the art as a banknote recycler.

In a conventional banknote storage unit, banknotes are stored between, and supported by, opposing strips of plastic tape which are in turn coiled around storage drums or reels.

Typically, banknote storage units comprise two storage drums and a further pair of tape supply drums. In operation, it is known to store banknotes in succession between windings of the tape on one or both of the storage drums, and the drums are driven to wind and unwind tape from storage drums to tape supply drums, and vice versa.

A problem exists with conventional banknote storage units in that when tape is being wound or unwound from one drum to another it is necessary to ensure that the tension in the tape is maintained in order that banknotes held between the tapes are held securely, and that no banknote displacement relative to the tape occurs.

Furthermore, as the diameter of tape increases or decrease on one drum (assuming a fixed rotational speed) it follows that the length of tape that is transferred to an associated drum for a single complete rotation increases or decreases correspondingly. In prior art arrangements this has been addressed by either providing some form of resistance to rotation on one drum whilst rotating the other, or by varying the rotational speeds of both associated drums by continual adjustment.

EP-B-2,321,804 discloses a banknote storage unit which comprises a single banknote storage drum and a pair tape supply drums. Here, the problem of maintaining the tension in the storage tape is addressed by arranging the pair of tape supply drums coaxially and providing a magnetic torque limiter.

An example of another conventional banknote storage unit is shown in accompanying FIGS. 7 and 8, and is described further in WO-A-2010/061160. Here, the banknote storage unit 100 comprises a first banknote storage drum 101 which is supplied with a first tape 107 from a first tape supply drum 103, and a second banknote storage drum 102 with a respective second tape supply drum 104 for supplying a second tape 108.

A motor M drives the first banknote storage drum 101 and the drive is transmitted via a first banknote storage drum drive gear 101' to second banknote storage drum drive gear 102' through a link gear 105. Similarly, the motor drive is transferred to a first tape supply drum drive gear 103' and a second tape supply drum drive gear 104' via a link gear 106.

With the conventional banknote storage unit of WO-A-2010/061160, the problem of maintaining tape tension is addressed by the provision of tensioning means fitted inside the second banknote storage drum 102, the first tape supply drum 103, and the second tape supply drum 104. The tensioning means is shown in FIG. 4 of WO-A-2010/061160, and it comprises a tension spring connected to the shaft of a respective drum via an arbour. Each spring is separately pre-tensioned and provides a biasing force to the drums that ensures that the tapes remain under tension and do not become slack as they are transported between the drums.

However, a problem exists with the conventional banknote storage unit described above in that it is difficult to optimise the amount of pre-tensioning to be applied to each spring in order that no imbalances occur during operation due to dynamic changes in the diameter of the various drums, and the fact that the drums are geared together and are driven in unison. Furthermore, when the first banknote storage drum 101 is being driven in an anticlockwise direction (banknote dispensing or transfer modes) tape warping may occur if tension in any of the springs is currently at a minimum, or when one or other of the springs fails to recoil, resulting in a sudden braking effect being applied to a drum. This situation is exacerbated when the tape travel distance between storage drums and supply drums is large.

Some conventional approaches to the problems existing in the prior art have involved utilising more than one drive motor. However, these solutions are eschewed since they require complex differential motor control and they add additional costs due to the inclusion of more than one motor.

The present invention arose from attempts to ameliorate some or all of the aforementioned problems associated with the prior art.

According to an aspect of the present invention there is provided a banknote storage unit as defined in claim 1.

In a preferred embodiment of the present invention the banknote storage first tape reel banknote storage device is rotatable and includes a first brake mechanism operatively connected to a first storage device drive cog, and the second tape reel banknote storage device is also rotatable and also includes a second brake mechanism operatively connected to a second storage device drive cog.

Preferably, the drive transmission means includes a drive cog arranged to respectively mesh with the first storage device drive cog and the second storage device drum drive cog when the drive transmission means is pivoted between respective engagement with the first tape reel banknote storage device and engagement with the second tape reel banknote storage device.

In one embodiment the first brake mechanism comprises at least one friction device contactable with the first storage device drive cog and the second brake mechanism comprises at least one friction device contactable with the second storage device drive cog.

Advantageously, the first brake mechanism and the second brake mechanism each comprise an urging means arranged to exert pressure on a respective at least one friction device. Each friction device can be a washer constructed from a plastics material, and each washer is coaxial with a respective storage device drive cog.

Preferably, the urging means comprises a substantially u-shaped metal clip arranged to press the washer into abutment with a respective drive cog recess.

Preferably, the washer includes a lug configured to mate with a corresponding lug receiving aperture in the substantially u-shaped metal clip.

Typically, the drive transmission means is operably connected to a drive motor, and the banknote storage unit is configured to interconnect with a banknote transport and validator mechanism.

An embodiment of the present invention will now be described, by way of example only, with reference to the accompanying schematic drawings, in which.

Figure 1:
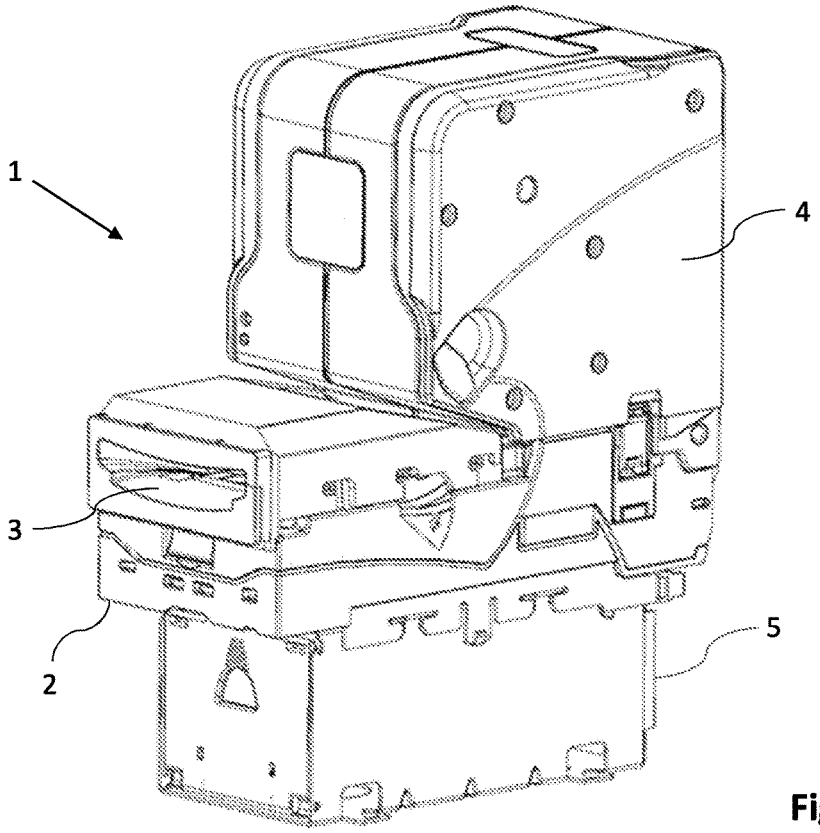
FIG. 1 shows a banknote recycler incorporating a banknote storage unit according to an embodiment of the present invention.

As shown in FIG. 1, a banknote recycler 1 comprises a banknote transport and validator mechanism 2 including a banknote input/output aperture 3, a cashbox 5, and a banknote storage unit 4.

Banknotes fed into the banknote recycler 1 via input/output aperture 3 are checked for authenticity by the banknote transport and validator mechanism 2. Rejected banknotes are returned to a user via the input/output aperture 3, and acceptable banknotes are either diverted to the cashbox 5 for later collection, or they are transported to the banknote storage unit 4 to be temporarily stored for dispensing as required at a later time.

Figure 2:
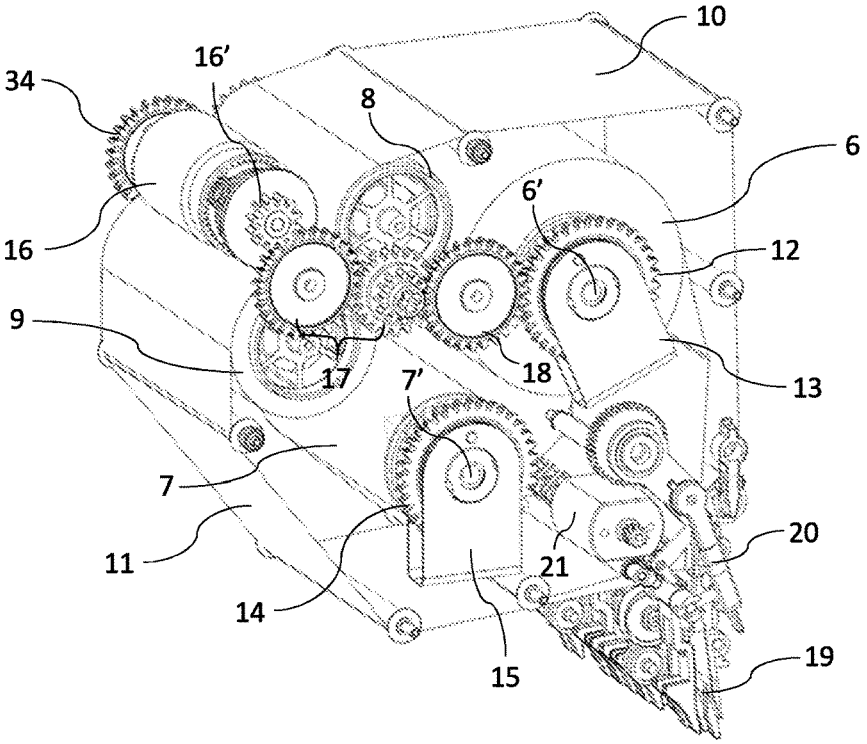
FIG. 2 is an internal perspective view of a banknote storage unit according to the present invention.

Banknotes that are determined to be acceptable and destined for the banknote storage unit 4 are routed through a validator mechanism internal banknote transport pathway (not shown) from where they are passed into the banknote storage unit 4 via banknote input/output path 19 (see FIG. 2).

With reference to FIG. 2, the input/output path 19 is configured to interconnect with the banknote transport pathway of the banknote transport and validator mechanism 2, and the input/output path 19 can be opened and closed as required by a diverter mechanism 20. The diverter mechanism 20 is independently driven by a diverter mechanism motor 21. In this way, banknotes can be transferred to and from the banknote storage unit 4 when the input/output path 19 is in an open position. Conversely, when the input/output path 19 is in a closed position, banknotes can be transferred between the first banknote storage tape drum 6 and the second banknote storage tape drum 7, or vice versa. Diverter mechanisms are well known in the art and no further explanation or description is considered necessary here.

As shown in FIG. 2, the first banknote storage tape drum 6 includes a first shaft 6' on which is mounted a first gear 12. Likewise, the second storage tape drum 7 includes a second gear 14 mounted on a second shaft 7'.

A first tape 10 is fed to the first banknote storage drum 6 from a first tape supply drum 8, and a second tape 11 is routed from a second tape supply drum 9 to the second banknote storage drum 7. Banknote storage drum and tape supply drum arrangements are well known in the art, consequently it is not considered necessary to describe how banknotes are held between opposing tapes and stored in consecutive fashion around the circumference of banknote storage drums.

The banknote storage unit 1 includes a drive gear train 17 interconnecting motor pinion 16' and drive cog 18. These elements are shown in FIG. 2 without structural support components for clarity. Rotational drive is provided by a motor 16 which is operatively connected to the motor pinion 16', which in turn transfers rotational drive to the drive gear train 17. The drive gear train 17 comprises first drive gear **17*a* and second drive gear 17*b* (see FIG. 3**).

The first banknote storage tape drum 6 includes a first brake mechanism 13 enclosing the first gear 12. Similarly, the second banknote storage tape drum 7 includes a second brake mechanism 15 enclosing the second gear 14. The brake mechanism will be described further below in relation to FIG. 5.

Figure 3:
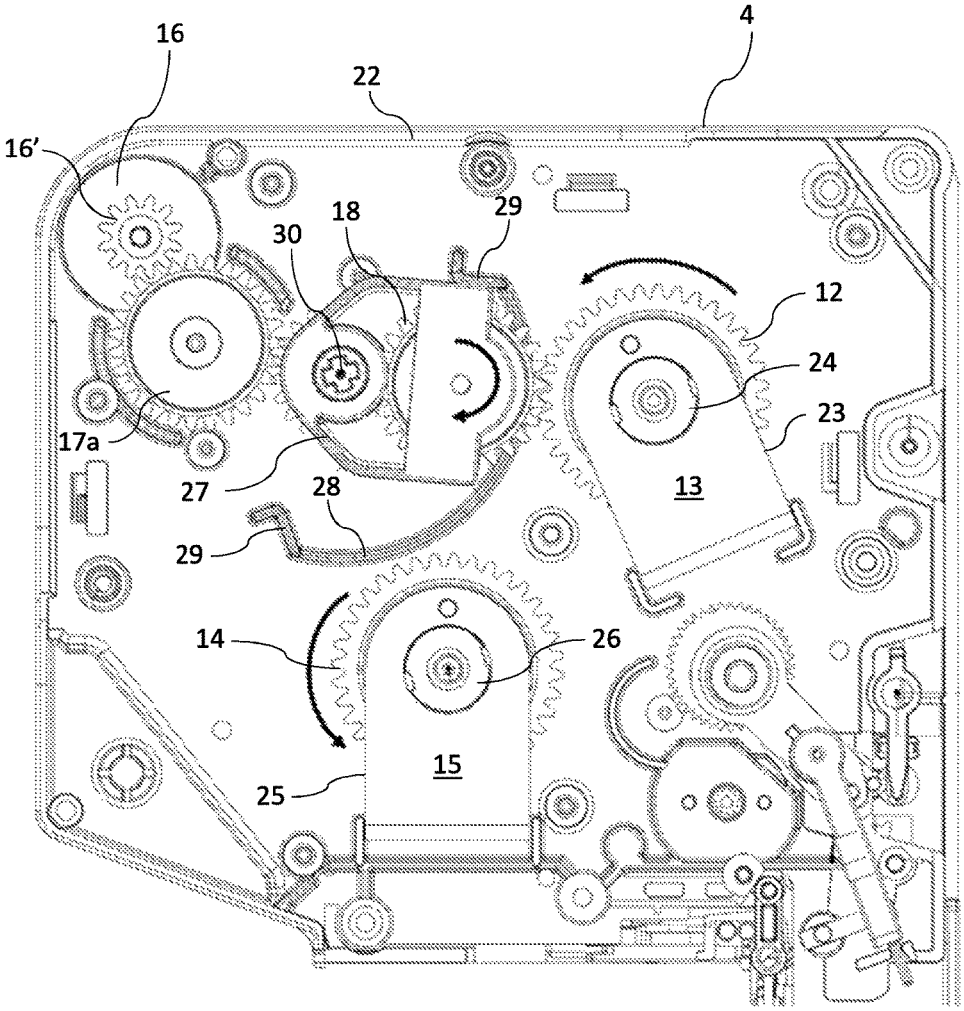
FIG. 3 is a side elevation view of the interior the banknote storage unit.

With reference to FIG. 3, a housing 22 provides a support structure for the various components of the banknote storage unit 4. As noted above, the motor pinion 16' transfers rotational drive to the drive cog 18 via intervening first drive gear **17*a* and second drive gear 17*b***.

Figure 4:
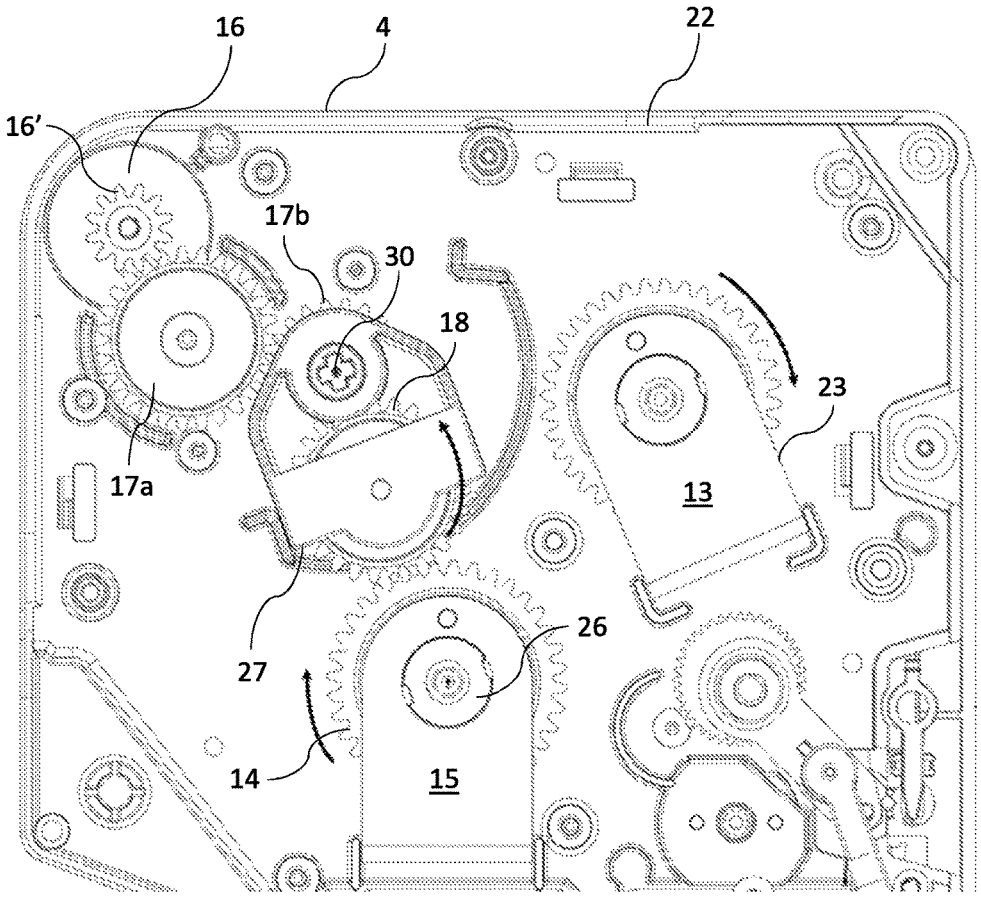
FIG. 4 is another side elevation view of the interior of the banknote storage unit.

The drive cog 18 and the second drive gear **17*b* are pivotably mounted to a drive carriage 27. The drive carriage 27 is rotatable about a carriage axle 30 and is pivotable between a first position in which the drive cog 18 is engaged with the first gear 12 (as shown in FIG. 3) and a second position in which the drive cog 18 is engaged with the second gear 14 (as shown in FIG. 4**).

Movement of the drive carriage 27 between the first position and the second position is assisted by an arcuate guide rib 28. The guide rib 28 is delimited by a pair of end stops 29 which are arranged to confine the movement of the drive carriage 27 and to provide abutment surfaces to facilitate rotation of the drive cog 18 at either end of the arcuate guide rib 28. Although not shown in the Figures, a toothed guide rail for engagement with the drive cog 18 can be deployed between the first and second gears 12, 14 to further assist the movement of the drive carriage 27 between the first and second positions.

During a banknote ingress operation, a banknote is fed from the banknote transport and validator mechanism 2 through the input/output path 19. During such an operation, and as shown in FIG. 3, the motor 16 is driven in an anticlockwise direction driving the drive cog 18 in a clockwise direction which in turn drives the first gear 12 in an anticlockwise direction. As the first gear rotates in an anticlockwise sense the first tape 10 is wound onto the first banknote storage drum 6 and unwound from the first tape supply drum 8. At the same time, the second tape 11 is unwound from the second banknote storage tape drum 7 by the tension resulting from the motor drive on the first tape 10. In this way, an input banknote (not shown) is transported by the first and second tapes and stored between the tapes in a wound manner on the first banknote storage drum 6.

It should be noted that when it is desired to transfer a banknote from the second banknote storage tape drum 7 to the first banknote storage tape drum 6, the drive carriage 27 will be arranged as shown in FIG. 3, with the only difference being that the diverter mechanism 20 (see FIG. 2) is changed from an open (banknote ingress/egress) position to a closed (banknote transfer) position.

FIG. 4 shows the arrangement of the banknote storage unit 4 during a banknote egress operation. It should be noted that the arrangement shown in FIG. 4 is identical to the arrangement required for the transfer of a banknote from the first banknote storage drum 6 to the second banknote storage drum 7 with the diverter mechanism in the closed (banknote transfer) position.

The motor 16 is reversed from anticlockwise to clockwise operation to drive the pinion 16' in a clockwise direction. The motor drive power is transferred from the pinion 16' via the drive gear train 17 to rotate the drive carriage 27 about the carriage axel 30. Because of the 'sticky' nature of the resistance between the second drive gear **17*b* and the drive cog 18, and the fact that the drive carriage 27 is initially abutting an end stop 29, the drive carriage 27 is urged by the clockwise rotation of the second drive gear 17***b* to rotate about axle 30 and to arcuately traverse along the guide rib 28 from the position shown in FIG. 3 until it reaches the opposing end stop 29 in the position shown in FIG. 4.

When the drive carriage 27 arrives at the position shown in FIG. 4, it abuts the opposing end stop 29 and the drive cog 18 engages with the second gear 14 of the second banknote storage tape drum 7. Once the drive cog 18 engages with the second gear 14, the second banknote storage tape drum 7 commences rotation in a clockwise manner. Because of this, the second tape 11 is wound onto the second banknote storage drum 7, and the first tape 10 is unwound from the first banknote storage drum 6 via the tension applied from the rotation of the second banknote storage tape drum 7. In this way a banknote(s) may be transferred from the first banknote storage tape drum 6 to the second banknote storage tape drum 7 or, when the diverter mechanism 19 is in the open position, a banknote(s) may be transferred from the first banknote storage tape drum 6 to the banknote transport and validator mechanism 2 via the banknote input/output path 19.

Figure 5:
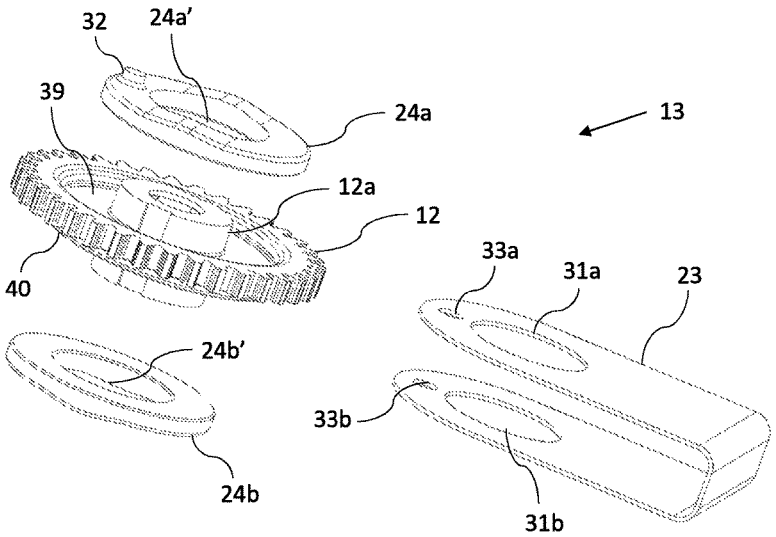
FIG. 5 is an explode perspective view illustrating the components of a brake mechanism according to the present invention.

The first banknote storage tape drum 6 and the second banknote storage tape drum 7 include a respective first and second brake mechanism 13, 15. For convenience, FIG. 5 shows an exploded perspective view of the first brake mechanism 13. However, it should be noted that the second brake mechanism is identical to the first, and will therefore not be separately described.

The first brake mechanism 13 comprises a substantially u-shaped spring clip 23, a first friction washer 24*a*, and a second friction washer 24*b*. In a preferred embodiment, the u-shaped clip 23 is constructed from a metal such as steel, and the washers are preferably constructed from a plastics material such as nylon. However, it should be understood that the clip or the washers may be fabricated from any suitable material as the particular application requires.

The first and second friction washers 24*a*, 24*b* are accommodated in respective washer recesses 39, 40 and are mounted by mating first and second axial lugs 12*a*, 12*b* with corresponding first and second washer holes 24*a*', 24*b*'. In addition, each friction washer 24*a*, 24*b* includes a washer lug 32 (only one shown) configured to mate with respective lug receiving apertures 33*a*, 33*b* positioned radially of spring clip apertures 31*a*, 31*b*, which are respectively disposed on either side of the substantially u-shaped first spring clip 23. In this way, axial rotation of the washers relative to the gears is prevented.

When axially mounted to respective first banknote storage drum 6 and second banknote storage drum 7, first and second spring clips 23, 25 clamp the friction washers 24, 26 to first and second gears 12, 14 respectively [see FIGS. 2 to 4]. Since the spring clips 23, 25 are inwardly resiliently biased, the friction washers 24*a*, 24*b*, 26*a*, 26*b* apply a braking force on respective first and second gears 12, 14 such that there is a resistance to rotation of the first and second shafts 6', 7'.

Figure 6:
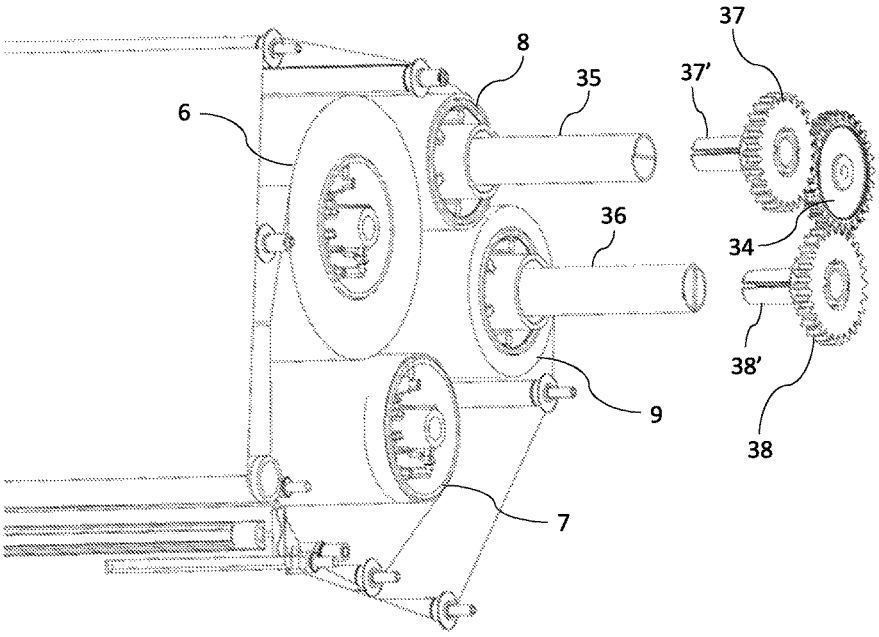
FIG. 6 is a partially explode perspective view of the banknote storage unit illustrating the tape supply drums.
Figure 8:
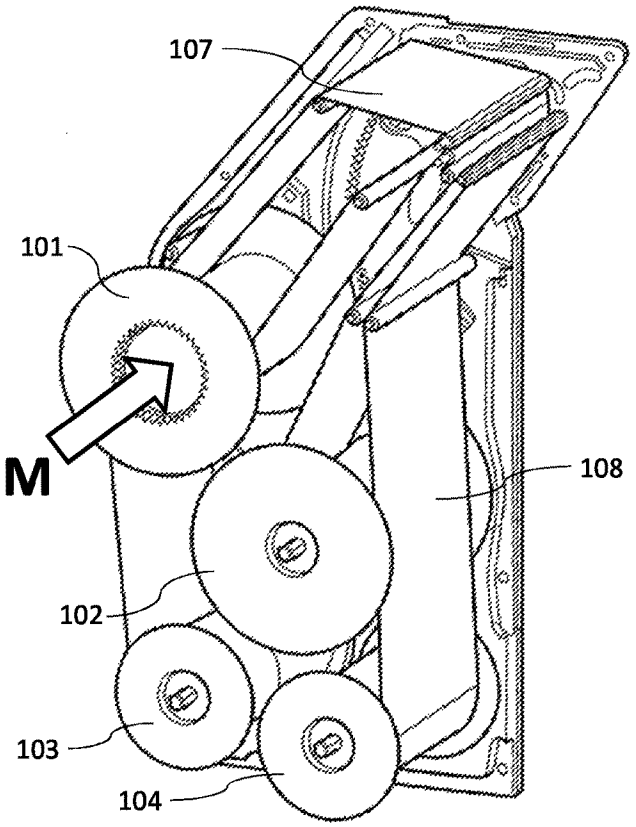
PRIOR ART Fig. 8.
FIG. 8 is an internal perspective view of the prior art banknote storage unit of FIG. 8.
Figure 7:
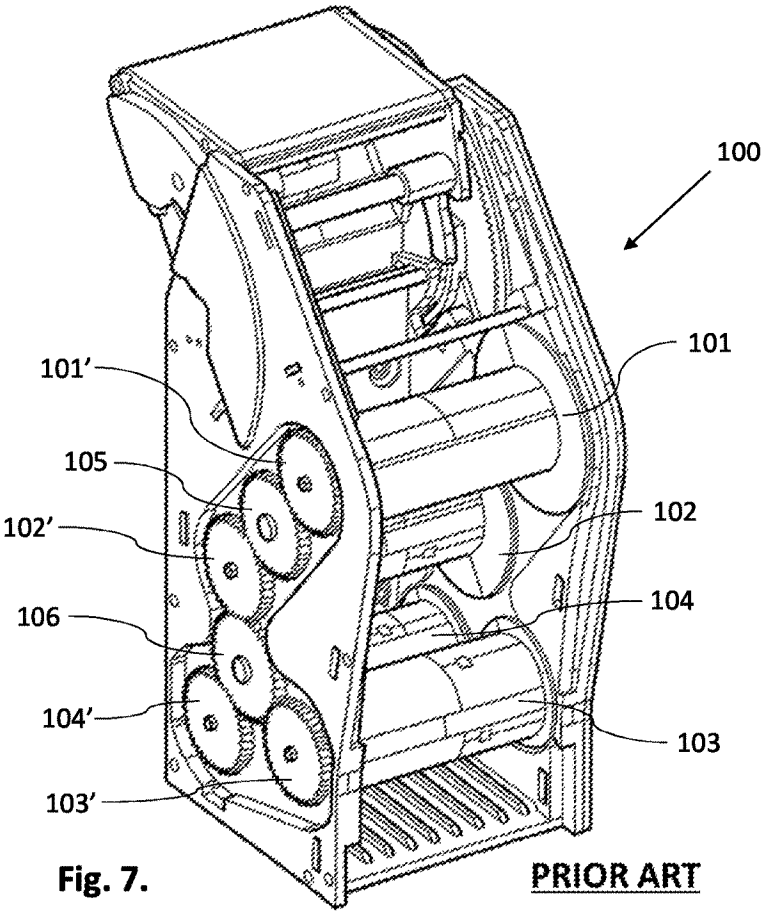
PRIOR ART Fig. 7.
FIG. 7 is a perspective view of a prior art banknote storage unit.

FIG. 6 illustrates the tensioning arrangement for the first tape supply drum 8 and the second tape supply drum 9.

The first tape supply drum 8 includes a first axially-extending biasing means 35 and the second tape supply drum 9 includes a second axially-extending biasing means 36. The first axially-extending biasing means 35 is configured to receive and mate with a male protrusion 37' of a first biasing gear, and the second axially-extending biasing means 36 is configured to receive and mate with a male protrusion 38' of a second biasing gear 38. The first and second biasing gears 37, 38 are mutually meshed with an interconnecting bridging gear 34.

The configuration shown in FIG. 6 ensures that during operation of the banknote storage unit 4, the first tape supply drum 8 and the second tape supply drum always rotate in the same sense, and the tension in the first tape 10 and the second tape 11 is maintained irrespective of the current condition of either of the tape supply drums or the first and second banknote storage drums 6, 7.

Advantageously, the banknote storage unit of the present invention allows rotational drive power to be reciprocally transferred between the banknote storage drums whilst only employing a single motor unit. A further advantage of the present invention is that correct tape tension is maintained without conventional spring tensioning means in the tape storage drums and without the need for mechanical interconnection between the first gear 12 and the second gear 14.

The invention claimed is:

1. A banknote storage unit comprising:

a first tape reel banknote storage device;

a second tape reel banknote storage device; and a drive transmission means moveable between engagement with said first tape reel banknote storage device and engagement with said second tape reel banknote storage device.

2. A banknote storage unit as claimed in claim 1, wherein the first tape reel banknote storage device is rotatable and includes a first brake mechanism operatively connected to a first storage device drive cog, and wherein the second tape reel banknote storage device is rotatable and includes a second brake mechanism operatively connected to a second storage device drive cog.

3. A banknote storage unit as claimed in claim 2, wherein the drive transmission means is pivotable and includes a drive cog arranged to respectively mesh with the first storage device drive cog and the second storage device drum drive cog when the drive transmission means is pivoted between respective engagement with the first tape reel banknote storage device and engagement with the second tape reel banknote storage device.

4. A banknote storage unit as claimed in claim 3, wherein the first brake mechanism comprises at least one friction device contactable with the first storage device drive cog and the second brake mechanism comprises at least one friction device contactable with the second storage device drive cog.

5. A banknote storage unit as claimed in claim 4, wherein the first brake mechanism and the second brake mechanism each comprise an urging means arranged to exert pressure on a respective at least one friction device.

6. A banknote storage unit as claimed in claim 5, wherein the at least one friction device is a washer, and wherein said washer is coaxial with a respective storage device drive cog.

7. A banknote storage unit as claimed in claim 6, wherein the urging means comprises a substantially u-shaped clip arranged to press the washer into abutment with a respective drive cog recess.

8. A banknote storage unit as claimed in claim 7, wherein the washer includes a lug configured to mate with a corresponding lug receiving aperture in the substantially u-shaped metal clip.

9. A banknote storage unit as claimed in claim 1, wherein the drive transmission means is operably connected to a drive motor.

10. A banknote storage unit as claimed in claim 1, wherein the banknote storage unit is configured to interconnect with a banknote transport and validator mechanism.

* * * * *